US011702848B2

(12) United States Patent
Boucké

(10) Patent No.: US 11,702,848 B2
(45) Date of Patent: Jul. 18, 2023

(54) PANEL, IN PARTICULAR A FLOOR PANEL OR WALL PANEL, AND PANEL COVERING

(71) Applicant: I4F Licensing NV, Hamont-Achel (BE)

(72) Inventor: Eddy Alberic Boucké, Menen (BE)

(73) Assignee: I4F Licensing NV, Turnhout (BE)

( * ) Notice: Subject to any disclaimer, the term of this patent is extended or adjusted under 35 U.S.C. 154(b) by 0 days.

(21) Appl. No.: 17/288,011

(22) PCT Filed: Sep. 30, 2019

(86) PCT No.: PCT/EP2019/076442

§ 371 (c)(1),
(2) Date: Apr. 23, 2021

(87) PCT Pub. No.: WO2020/083615

PCT Pub. Date: Apr. 30, 2020

(65) Prior Publication Data

US 2021/0404189 A1 Dec. 30, 2021

(30) Foreign Application Priority Data

Oct. 26, 2018 (NL) ..... 2021886

(51) Int. Cl.
*E04F 15/02* (2006.01)
*E04F 13/08* (2006.01)

(52) U.S. Cl.
CPC .... *E04F 15/02038* (2013.01); *E04F 13/0894* (2013.01); *E04F 2201/0146* (2013.01);
(Continued)

(58) Field of Classification Search
CPC ..... E04F 15/02038; E04F 15/105; E04F 2201/0146; E04F 2201/023;
(Continued)

(56) References Cited

U.S. PATENT DOCUMENTS 10,337,191 B2 7/2019 Cappelle
2002/0100242 A1* 8/2002 Olofsson ..... E04F 13/16 52/592.1

(Continued)

FOREIGN PATENT DOCUMENTS

WO 2015130160 A1 9/2015
WO 2016046800 A1 3/2016
WO 2017115202 A1 7/2017

*Primary Examiner* — Gisele D Ford
(74) *Attorney, Agent, or Firm* — The Webb Law Firm

(57) ABSTRACT

A panel including a centrally located core, at least one first coupling part and at least one second coupling part connected respectively to opposite edges of the core, which first coupling part includes an upward tongue, at least one upward flank lying at a distance from the upward tongue and an upward groove formed in between the upward tongue and the upward flank wherein the upward groove is adapted to receive at least a part of a downward tongue of a second coupling part of an adjacent panel: which second coupling part includes a downward tongue, at least one downward flank lying at a distance from the downward tongue, and a downward groove formed in between the downward tongue and the downward flank, wherein the downward groove is adapted to receive at least a part of an upward tongue of a first coupling part of an adjacent panel.

23 Claims, 4 Drawing Sheets

(52) U.S. Cl.
CPC ... *E04F 2201/023* (2013.01); *E04F 2201/042* (2013.01); *E04F 2201/043* (2013.01)

(58) Field of Classification Search
CPC ..... E04F 2201/042; E04F 13/0894; E04F 2201/041; E04F 2201/03
See application file for complete search history.

(56) References Cited

U.S. PATENT DOCUMENTS

| | | | | |
|---|---|---|---|---|
| 2005/0028474 | A1* | 2/2005 | Kim | E04F 15/04 52/578 |
| 2007/0266666 | A1* | 11/2007 | Dammers | E04F 13/08 52/536 |
| 2014/0033633 | A1 | 2/2014 | Kell | |
| 2018/0010342 | A1* | 1/2018 | Van Hooydonck | E04F 15/105 |
| 2020/0063443 | A1* | 2/2020 | Boucké | B32B 27/20 |
| 2021/0002907 | A1* | 1/2021 | Boucké | E04F 15/105 |

* cited by examiner

PANEL, IN PARTICULAR A FLOOR PANEL OR WALL PANEL, AND PANEL COVERING

CROSS-REFERENCE TO RELATED APPLICATIONS

This application is the United States national phase of International Application No. PCT/EP2019/076442 filed Sep. 30, 2019, and claims priority to The Netherlands Patent Application No. 2021886 filed Oct. 26, 2018, the disclosures of which are hereby incorporated by reference in their entirety.

BACKGROUND OF THE INVENTION

Field of the Invention

The present invention relates to a panel, in particular a floor panel, ceiling panel, or a wall panel. The invention also relates to a covering, in particular a floor covering, ceiling covering, or wall covering, comprising a plurality of mutually coupled panels according to the invention.

Description of Related Art

The last decade has seen enormous advance in the market for laminate for hard floor covering. It is known to install floor panels on a underlying floor in various ways. It is, for example, known that the floor panels are attached at the underlying floor, either by gluing or by nailing them on. This technique has a disadvantage that is rather complicated and that subsequent changes can only be made by breaking out the floor panels. According to an alternative installation method, the floor panels are installed loosely onto the subflooring, whereby the floor panels mutually match into each other by means of a tongue and groove coupling, whereby mostly they are glued together in the tongue and groove, too. The floor obtained in this manner, also called a floating parquet flooring, has as an advantage that it is easy to install and that the complete floor surface can move which often is convenient in order to receive possible expansion and shrinkage phenomena. A disadvantage with a floor covering of the above-mentioned type, above all, if the floor panels are installed loosely onto the subflooring, consists in that during the expansion of the floor and its subsequent shrinkage, the floor panels themselves can drift apart, as a result of which undesired gaps can be formed, for example, if the glue connection breaks. In order to remedy this disadvantage, techniques have already been through of whereby connection elements made of metal are provided between the single floor panels in order to keep them together. Such connection elements, however, are rather expensive to make and, furthermore, their provision or the installation thereof is a time-consuming occupation. Floor panels having complementarily shaped coupling parts at opposing panel edges are also known. These known panels are typically rectangular and have complementarily shaped angling-down coupling parts at opposing long panel edges and complementarily shaped fold-down coupling parts at opposing short panel edges. Installation of these known floor panels is based upon the so-called fold-down technique, wherein the long edge of a first panel to be installed is firstly coupled to or inserted into the long edge of an already installed second panel in a first row, after which the short edge of the first panel is coupled to the short edge of an already installed third panel in a second row during lowering (folding down) the first panel, which installation fulfils the targeted requirement of a simple installation. In this manner a floor covering consisting of a plurality of parallel oriented rows of mutually coupled floor panels can be realized.

WO2017/115202 for example describes a floor panel for forming a floor covering, wherein the floor covering consists of floor panels, which, on at least one pair of edges, are provided with coupling parts, that these coupling parts substantially are manufactured from the material of the floor panel, and that these coupling parts are configured such that two such floor panels, at said pair of edges, can be installed and locked to each other by means of a downward movement and/or by means of the fold-down principle.

SUMMARY OF THE INVENTION

It is an object of the invention to provide a panel, wherein multiple panels can be mutually coupled in an improved manner.

According to a first aspect, the invention relates to a panel according to the preamble, comprising: a centrally located core provided with an upper side and a lower side, which core defines a plane; at least one first coupling part and at least one second coupling part connected respectively to opposite edges of the core, which first coupling part comprises: an upward tongue, at least one upward flank lying at a distance from the upward tongue, and an upward groove formed in between the upward tongue and the upward flank wherein the upward groove is adapted to receive at least a part of a downward tongue of a second coupling part of an adjacent panel, wherein at least a part of a proximal side of the upward tongue, facing the upward flank, is upwardly inclined towards the upward flank, which second coupling part comprises: a downward tongue, at least one downward flank lying at a distance from the downward tongue, and a downward groove formed in between the downward tongue and the downward flank, wherein the downward groove is adapted to receive at least a part of an upward tongue of a first coupling part of an adjacent panel; wherein at least a part of a proximal side of the downward tongue, facing the upward flank, is downwardly inclined towards the downward flank, wherein the first coupling part and the second coupling part are configured such that in coupled condition a pretension is existing, which forces the respective panels at the respective edges towards each other, wherein this preferably is performed by applying overlapping contours of the first coupling part and the second coupling part, in particular overlapping contours of downward tongue and the upward groove and/or overlapping contours of the upward tongue and the downward groove, and wherein the first coupling part and the second coupling part are configured such that the two of such panels can be coupled to each other by means of a fold-down movement and/or a vertical movement, such that, in coupled condition, wherein, in coupled condition, at least a part of the downward tongue of the second coupling part is inserted in the upward groove of the first coupling part, such that the downward tongue is clamped by the first coupling part and/or the upward tongue is clamped by the second coupling part and wherein the upward tongue is oversized with respect to the downward groove.

According to a second aspect, the invention relates to a panel according to the preamble, comprising: a centrally located core provided with an upper side and a lower side, which core defines a plane; at least one first coupling part and at least one second coupling part connected respectively to opposite edges of the core, which first coupling part comprises: an upward tongue, at least one upward flank lying at a distance from the upward tongue, an upward groove formed in between the upward tongue and the upward flank wherein the upward groove is adapted to receive at least a part of a downward tongue of a second coupling part of an adjacent panel, and at least one first locking element, preferably provided at a distant side of the upward tongue facing away from the upward flank, which second coupling part comprises: a downward tongue, at least one downward flank lying at a distance from the downward tongue, a downward groove formed in between the downward tongue and the downward flank, wherein the downward groove is adapted to receive at least a part of an upward tongue of a first coupling part of an adjacent panel, and at least one second locking element adapted for co-action with a first locking element of an adjacent panel, said second locking element preferably being provided at the downward flank, wherein the first coupling part and the second coupling part are configured such that in coupled condition a pretension is existing, which forces the respective panels at the respective edges towards each other, wherein this preferably is performed by applying overlapping contours of the first coupling part and the second coupling part, in particular overlapping contours of the downward tongue and the upward groove and/or overlapping contours of the upward tongue and the downward groove, and wherein the first coupling part and the second coupling part are configured such that the two of such panels can be coupled to each other by means of a fold-down movement and/or a vertical movement, such that, in coupled condition, wherein, in coupled condition, at least a part of the downward tongue of the second coupling part is inserted in the upward groove of the first coupling part, such that the downward tongue is clamped by first coupling part, such that at least a part of the second coupling part is clamped by the first coupling part and/or at least a part of the first coupling part is clamped by the second coupling part, and wherein the upward tongue is oversized with respect to the downward groove.

The pretension referred to means that the coupling parts exert forces onto each other in coupled condition, which are such that the coupling parts, and hence the respective panels at the respective edges are forced (pushed) towards each other, wherein the first coupling part and the complementary second coupling part mutually cooperate in a clamping manner. This will significantly improve the stability and reliability of the coupling of the first coupling part and the second coupling part, and will prevent the coupling parts from drifting apart (which would create a gap in between adjacent panels), while maintaining the big advantage that the panels are configured to be coupled by means of a fold-down movement and/or vertical movement, also referred to as a scissoring movement or zipping movement, and hence by using the user-friendly fold-down technology. The pretension is preferably realized by using overlapping contours of the first coupling part and the second coupling part, in particular overlapping contours of the downward tongue and the upward groove and/or overlapping contours of the upward tongue and the downward groove. Overlapping contours doesn't mean that the complete contour should overlap, and merely requires that at least of part of the (outer) contour of the first coupling part overlaps with at least a part of the (outer) contour of the second coupling part. The contours are typically compared by considering the contours of the first coupling part and the second coupling part from a side view (or cross-sectional view). By applying overlapping contours, the first coupling part and/or the second coupling part will typically remain (elastically) deformed, in particular squeezed and/or bent, in a coupled state, provided the desired stability of the coupling. Normally, with overlapping contours the downward tongue will be (slightly) oversized with respect to the upward groove, and/or the upward tongue will be (slightly) oversized with respect to the downward groove. However, it should be understood that overlapping contours may also be realized in another manner, for example by applying overlapping first and second locking elements.

During coupling of the panels, the upward tongue may be (elastically) deformed, in particular squeezed and/or bent. Bending will take place from its initial position (slightly) in outward direction, away from the upward flank. A bent state of the upward tongue may remain in the coupled state of two panels. The bending angle of the proximal side of the upward tongue, facing the upward flank, will commonly be restricted and situated in between 0 and 2 degrees. The oversize should be sufficiently large to realize the desired pretension, which pretension normally takes place already at a minimum oversize, though should at the other hand preferably be sufficiently limited to allow and secure proper and user-friendly installation. Preferably, the width of the downward tongue is oversized with respect to the width of the upward groove. This oversize is typically in the order magnitude of 0.05-0.5 mm. The maximum width of the downward tongue preferably exceeds the maximum width of the upward groove. This will commonly further contribute to keeping the panels push to each other to keep the coupling, and hence the seam, as tight (free of play) as possible. In order to secure the panels in a single (horizontal) plane, it is advantageous in case the height of the downward tongue is equal to or smaller than the height of the upward groove.

The upward tongue is oversized with respect to the downward groove. The width of the upward tongue is oversized with respect to the width of the downward groove. Here, the maximum width of the upward tongue exceeds the maximum width of the downward groove, which also leads to pretension between the first coupling part and second coupling part. However, in this case it is preferred that the downward groove is not widened during coupling, or at least does not remain widened in coupled condition, in order to secure a tight seam between the panels and the prevent an offset between the panels. In case the panels edges are chamfered, in particular bevelled, a small offset will not be visible though, which therefore allow a small offset (due to (slight) widening of the downward groove and upward bending of the downward tongue in coupled condition). The height of the upward tongue is preferably equal to or smaller than the height of the downward groove. This will facilitate the keep coupled panels are the same level (within a joint (horizontal plane). This oversize, preferably the (maximum) width oversize and/or the cross-sectional surface area oversize, of the upward tongue with respect to the downward groove is typically in the order magnitude of 0.05-0.5 mm. This would result in an acceptable extend of pretension wherein, in a coupled condition, the respective panels at the respective edges are forced towards each other, wherein the first coupling part and the complementary second coupling part mutually cooperate in a clamping manner without causing significant (undesired) material stress. It is however also conceivable that the oversize of the tongue is in the order of magnitude of 0.5 to 1.0 mm, or wherein the oversize is over 1 mm. When the oversize is over 1 mm it might be desirable to use a slightly flexible (semi-rigid) core material. The oversized tongue may possibly slightly deform during coupling and/or in the coupling condition. It is for example also conceivable that at least a part of the upward tongue is at least 3%, and preferably at least 5% oversized with respect to at least a part of the downward groove, in particular at least of part of the downward groove which is configured to co-act with said oversized part of the upward tongue (in coupled condition of adjacent panels). This can be in the width direction, and/or this can be a cross-sectional surface area oversize, but may also be the case for the tongue as a whole. The upward tongue can also be oversized with respect to the downwards groove in a vertical direction, preferably such that, in a coupled condition, the oversized upward tongue is slightly forced in a downward direction by the downward groove. This is in particular possible if a recessed portion is present underneath the upward tongue which provides room for the upward tongue to bend downwards. In a non-coupled condition of panel having such configuration, the overlap of the contours of the upward tongue with respect to the downward groove can be relatively large.

The locking elements of the coupling parts contribute to the locking of coupled panels. The cooperation of the tongues and the grooves for instance contributes to a horizontal locking, or locking in the plane of the coupled panels. The first and second locking elements typically contribute either to the vertical locking, or locking in a plane perpendicular to the plane of the coupled panels, or they contribute to rotational locking, such that two panels cannot be swivelled free, or that such swivelling is reduced.

In a preferred embodiment, a lower side of the first coupling part is provided with a recessed portion configured to allow downward bending of the upward tongue, preferably such that the upward groove is widened to facilitate coupling of two panels. By providing the recessed portion, a space is created underneath the first coupling part which allows and facilitates downward bending (deflection) of the upward tongue. can be taken up by tongue material during coupling. This deflection of the upward tongue allows the upward groove to widen at least during coupling, which larger upward groove facilitates coupling of two panels into each other. This widened state of the upward groove and bent state of the upward tongue may remain in coupled state of adjacent panels. Typically, during coupling of the panels, the upward tongue may bend downwardly into the recessed portion, and then returns at least partially in the direction of its initial position. In a coupled state of the first coupling part and the second coupling part of adjacent panels, the coupling parts typically force the panels towards each other under a tension force exerted by at least one of the coupling parts. This tension force forces coupled panels together, or towards each other, and thus increases the locking of coupled panels. In case the upward tongue remains in bended state in a coupled condition of adjacent panels, at least a part of the upward tongue will be situated slightly lower than the initial position of the upward tongue in uncoupled state. The difference in height between the initial position (in uncoupled state) and the bended position (in coupled state) may be between 0.1 and 5 mm, typically between 0.2 and 2 mm.

The recessed portion may for instance be formed by a milled out groove, that when the panel is placed on a horizontal subfloor or surface, also extends in horizontal direction. Alternatively, the groove extends from a distance of the bottom side of the panel. Typically, the first coupling part comprises a lower bridge connected to the core of the panel, wherein the upward tongue is connected to said lower bridge and extends in upward direction with respect to said lower bridge. The recessed portion, preferably a chamfered portion, may be positioned underneath the upward tongue only. However, it is commonly more preferred in case the recessed portion is positioned underneath both at least a part of the upward tongue and at least a part of the lower bridge, preferably at least half of the width of the lower bridge. This latter embodiment will commonly facilitate bending of the upward tongue with respect to the lower bridge. The recessed portion normally extends to the distal side of the upward tongue, facing away from the upward flank.

In cross-sectional view of the panel, the recessed portion may have a substantially rectangular cross section. With cross sectional view, a view is intended that is taken along one of the main directions of the panel. Panels, or floor panels, tend to have a square or rectangular shape, wherein the cross sectional view is taken along one of the centre lines of the panel. Such shape is relatively easy to produce, for instance by milling out a portion of the panel with conventional milling techniques. This milled out part of the panel may be used as resource in the production of future panels. However, it is also imaginable that the recessed portion is a chamfered portion having an (upwardly) inclined surface with respect to the plane defined by the panel. Typically this chamfered portion and (a remaining part of) the lower side of the panel mutually enclose an obtuse angle, which is commonly more robust, and hence less fragile and vulnerable compared to material surfaces enclosing an acute angle and/or a perpendicular.

The inward transition from the recessed portion to (a remaining part of) the lower side of the panel may at least be partially curved, or the inward transition from the recessed portion to the core of the panel may be square. A curved transition of the recessed portion allows for a smooth transition between the recessed portion and the core, wherein forces exerted on the panel may be transferred rather smoothly as well. On the other hand, a square transition is relatively easy to manufacture.

In a preferred embodiment the—normally sole (and hence complete)—upper side of the upward tongue is downwardly inclined from the proximal side of the upward tongue, facing the upward flank, towards the distal side of the upward tongue, facing away from the upward flank. Preferably, at least a part of, and preferably the complete, upper side of the downward groove is inclined downwardly towards the downward flank. Preferably, both inclinations mutually enclose an angle between (and including) 0 and 5 degrees. The inclination of the upper side of the upward tongue is preferably situated between 15 and 45 degrees, more preferably between 25 and 35 degrees, and is most preferably about 30 degrees, with respect to a horizontal plane (being a plane defined by the panel). The inclination of the upper side of the upward tongue is preferably constant, which means the upper side has a substantially flat orientation. Preferably, the upper side of the downward groove has a, preferably likewise (compared to the inclination of the upper side of the upward tongue) inclining orientation, which is more preferably upward in the direction of downward tongue. As already indicated above, typically the first coupling part comprises a lower bridge connected to the core of the panel, wherein the upward tongue is connected to said lower bridge and extends in upward direction with respect to said lower bridge. An upper side of the lower bridge defines a lower side of the upward groove. Also typically, the second coupling part comprises an upper bridge connecting the core with the downward tongue, wherein the downward tongue extends downwardly with respect to said upper bridge. A lower side of the upper bridge defines an upper side of the downward groove. Applying an inclined upper side of the downward groove will result in a varying thickness of the upper bridge, as seen from the core in the direction of the downward tongue. This position-dependent bridge thickness, wherein the bridge thickness is preferably relatively large close to the core and relatively small close to the downward tongue, bridge thickness has multiple advantages. The thicker part of the upper bridge, close to the core, provides the bridge more and sufficient strength and robustness, while the thinner part of the upper bridge, close to the sideward tongue and/or downward tongue, forms the weakest point of the bridge and will therefore be decisive for the location of first deformation (pivoting point) during coupling. Since this point of deformation is located close to the downward tongue the amount of material to be deformed to be able to insert the downward tongue into the upward groove of an adjacent panel can be kept to a minimum. Less deformation leads to less material stress which is in favour of the life span of the coupling part(s) and hence of the panel(s). In the coupled state of adjacent panels, the upper side of the first downward recess or second downward recess could be at least partially, and preferably substantially completely, supported by the upper side of the upward locking element, which provides additionally strength to the coupling as such. To this end, it is advantageous that the inclination of the upper side of the downward groove substantially corresponds to the inclination of the upper side of the upward tongue. This means that the inclination of the upper side of the downward is preferably situated between 15 and 45 degrees, more preferably between 25 and 35 degrees, and is most preferably about 30 degrees, with respect to a horizontal plane. This inclination may be either flat or rounded, or eventually hooked.

The first locking element comprises a bulge, and the second locking element comprises a bulge. The bulge is commonly adapted to be at least partially received in the recess of an adjacent coupled panel for the purpose of realizing a locked coupling, preferably a vertically locked coupling. It is also conceivable that the first locking element and the second locking are not formed by a bulge-recess combination, but by another combination of co-acting profiled surfaces and/or high-friction contact surfaces. In this latter embodiment, the at least one locking element of the first locking element and second locking element may be formed by a (flat of otherwise shaped) contact surface composed of a, optionally separate, plastic material configured to generate friction with the other locking element of another panel in engaged (coupled) condition. Examples of plastics suitable to generate friction include:

- Acetal (POM), being rigid and strong with good creep resistance. It has a low coefficient of friction, remains stable at high temperatures, and offers good resistance to hot water;
- Nylon (PA), which absorbs more moisture than most polymers, wherein the impact strength and general energy absorbing qualities actually improve as it absorbs moisture. Nylons also have a low coefficient of friction, good electrical properties, and good chemical resistance;
- Polyphthalamide (PPA). This high performance nylon has through improved temperature resistance and lower moisture absorption. It also has good chemical resistance;
- Polyetheretherketone (PEEK), being a high temperature thermoplastic with good chemical and flame resistance combined with high strength. PEEK is a favourite in the aerospace industry;
- Polyphenylene sulphide (PPS), offering a balance of properties including chemical and high-temperature resistance, flame retardance, flowability, dimensional stability, and good electrical properties;
- Polybutylene terephthalate (PBT), which is dimensionally stable and has high heat and chemical resistance with good electrical properties;
- Thermoplastic polyimide (TPI) being inherently flame retardant with good physical, chemical, and wear-resistance properties.
- Polycarbonate (PC), having good impact strength, high heat resistance, and good dimensional stability. PC also has good electrical properties and is stable in water and mineral or organic acids; and
- Polyetherimide (PEI), maintaining strength and rigidity at elevated temperatures. It also has good long-term heat resistance, dimensional stability, inherent flame retardance, and resistance to hydrocarbons, alcohols, and halogenated solvents.

Preferably, at least in an uncoupled condition of the panel, the first locking element is positioned at a higher level than the second locking element. Preferably, a centre line (centre axis) of the first locking element is positioned at a higher level than a centre line (centre axis) of the second locking element. Hence, preferably, at least in an uncoupled condition of the panel, the first locking element and the second locking element have an offset position. In coupled condition of the panel with another panel, the first locking element of a first panel may be positioned at substantially the same level as the second locking element of an adjacent panel. Here, it is imaginable that said locking element and said second locking element are still (slightly) offset with respect to each other, though commonly the distance between the centre line (centre axis) of said first locking element and the centre line (centre axis) of said second locking element will decrease during coupling, wherein said distance will be smaller (or even zero) in coupled condition compared to the initial uncoupled condition of the panels.

In a preferred embodiment, a part of a side of the downward tongue facing away from the downward flank is provided with a third locking element, for instance in the form of an outward bulge or a recess, adapted for co-action with a fourth locking element, for instance in the form, respectively, of a recess or an outward bulge, of an adjacent panel; and wherein at least a part of the upward flank is provided with a fourth locking element, for instance in the form of a recess or an outward bulge, adapted for co-action with the third locking element, for instance in the form of an outward bulge or a recess, of an adjacent panel. Also this third and fourth locking element may contribute to improve the vertical locking between coupled panels. It is imaginable that the third and fourth locking elements and the first and second locking elements are applied in a panel according to the invention. It is also imaginable that instead of the first and second locking elements, the panel comprises the third and fourth locking elements. The alternative positioning of the third and fourth locking elements, compared to the first and second locking elements, has the advantage that the locking elements are positioned close to the upper seam formed between adjacent panels, which contributes to the stabilization of said seam, and which counteracts that panels will vertically shift with respect to each other close to the seam. It is indicated that a plurality of first locking elements, second locking element, third locking elements, and/or fourth locking elements may be applied. More preferably, the co-action between the third locking element and the fourth locking element for creating a vertical locking effect in coupled condition of two panels, which co-action creating vertical locking typically takes place at lower side of the third locking element and a lower side of the fourth locking element, defines a tangent T1 which encloses an angle A1 with a plane defined by the panel, which angle A1 is smaller than an angle A2 enclosed by said plane defined by the panel and a tangent T2 defined by a co-action between an inclined part of a proximal side of the upward tongue facing toward upward flank, and an inclined part of a proximal side of the downward tongue facing toward the downward flank. Here, preferably, the greatest difference between angle A1 and angle A2 is situated between 5 and 20 degrees. It is preferable that said third locking element and said fourth locking element are positioned closer to the upper side of the panel compared to an upper side of the upward tongue. This will reduce the maximum deformation of one or more coupling parts, whereas the connection process and deformation process can be executed in successive steps. Less deformation leads to less material stress which is in favour of the life span of the coupling parts and hence of the panel(s).

Preferably, at least a part of the first coupling part and/or at least a part of second coupling part of each panel is integrally connected to the core layer. In this case one-piece panels are formed, which are relatively easy and cost-efficient to produce.

It is conceivable that the core has a thickness, which thickness is the distance between the upper side and the lower side of the core. A further embodiment of the panel is conceivable wherein the side of the upward tongue facing away from the upward flank is located at a distance from the upward flank, wherein the distance is less than the thickness of the core and wherein the recess portion extends at least 75% of the distance (D), and preferably extends over the complete distance.

By having the distance between the outside of the upward tongue and the upward flank arranged to be less than the thickness of the core, a relative short protruding element is produced, which limits the vulnerability of the coupling parts. On the other hand, by having the recessed portion to extend over a large portion of the distance, several benefits may be achieved. For one, this allows for relative much material savings. The material which is removed in order to form the recessed portion can be recycled in new panels, and by removing more material, more material can be reintroduced in the system. Secondly, the relatively large recess allows a gradual bending of the upward tongue, as the bending can be spread out over a larger surface area.

The panel according to the invention may be rigid or may be flexible (resilient), or slightly flexible (semi-rigid). Each panel panels are typically is made as one of the following kinds: as a laminate floor panel; as a so-called "resilient floor panel"; a "LVT" (luxury vinyl panel) panel or "VCT panel" (vinyl composition panel) or comparable thereto panel on the basis of another synthetic material than vinyl; a floor panel with a first synthetic material-based, preferably foamed, substrate layer (core layer), with thereon a preferably thinner second substrate layer (second core layer) of or on the basis of vinyl or another synthetic material; as a floor panel with a hard synthetic material-based substrate. In case a relatively rigid material is used for manufacturing the panel, and in particular the coupling parts, the material should allow (slight) deformation in order to couple adjacent panels in such a way that a pretension will be created between the coupled coupling parts of said panels. This is in particular beneficial for the embodiment according to the present invention wherein the upward tongue is oversized with respect to the downward groove and/or wherein the downward tongue is oversized with respect to the width of the upward groove.

The core may be formed of a single material (single core layer). However, typically, the core comprises a plurality of core layers. Different core layers may have the same composition, although it is more preferred that at least two different core layers have different compositions, in order to improve the overall properties of the core. At least one core layer may be made of a composite of at least one polymer and at least one non-polymeric material. The composite of the core layer preferably comprises one or more fillers, wherein at least one filler is selected from the group consisting of: talc, chalk, wood, calcium carbonate, titanium dioxide, calcined clay, porcelain, a(nother) mineral filler, and a(nother) natural filler. The filler may be formed by fibres and/or may be formed by dust-like particles. Here, the expression "dust" is understood as small dust-like particles (powder), like wood dust, cork dust, or non-wood dust, like mineral dust, stone powder, in particular cement. The average particle size of the dust is preferably between 14 and 20 micron, more preferably between 16 and 18 micron. The primary role of this kind of filler is to provide the core layer sufficient hardness. This will typically also improve the impact strength of the core layer and of the panel(s) as such. The weight content of this kind of filler in the composite is preferably between 35 and 75%, more preferably between 40 and 48% in case the composite is a foamed (expanded) composite, and more preferably between 65 and 70% in case the composite is a non-foamed (solid) composite.

Polymer materials suitable for forming at least a part of at least one core layer may include polyurethane (PUR), polyamide copolymers, polystyrene (PS), polyvinyl chloride (PVC), polypropylene, polyethylene terephthalate (PET), polyisocyanurate (PIR), and polyethylene (PE) plastics, all of which have good moulding processability. The at least one polymer included in the core layer may either may be solid or may be foamed (expanded). Preferably, chlorinated PVC (CPVC) and/or chlorinated polyethylene (CPE) and/or another chlorinated thermoplastic material is/are used to further improve the hardness and rigidity of the core layers, and of the panels as such, reducing the vulnerability of the—optionally pointed—corners of each panel. Polyvinyl chloride (PVC) materials are especially suitable for forming the core layer because they are chemically stable, corrosion resistant, and have excellent flame-retardant properties. The plastic material used as plastic material in the core layer is preferably free of any plasticizer in order to increase the desired rigidity of the core layer, which is, moreover, also favourable from an environmental point of view.

The core layer may also at least partially be composed of a, preferably PVC-free, thermoplastic composition. This thermoplastic composition may comprise a polymer matrix comprising (a) at least one ionomer and/or at least one acid copolymer; and (b) at least one styrenic thermoplastic polymer, and, optionally, at least one filler. An ionomer is understood as being a copolymer that comprises repeat units of electrically neutral and ionized units. Ionized units of ionomers may be in particular carboxylic acid groups that are partially neutralized with metal cations. Ionic groups, usually present in low amounts (typically less than 15 mol % of constitutional units), cause micro-phase separation of ionic domains from the continuous polymer phase and act as physical crosslinks. The result is an ionically strengthened thermoplastic with enhanced physical properties compared to conventional plastics.

In an alternative configuration of the panel according to the invention, the panel comprises a substantially rigid core layer at least partially made of a non-foamed (solid) composite comprising at least one plastic material and at least one filler. A solid core layer may lead to an improved panel strength, and hence a reduced vulnerability of the pointed vertexes, and may further improve the suitability to use the panels to realize a chevron pattern. A drawback of applying a solid composite in the core layer instead of a foamed composite in the core layer is that the panel weight will increase (in case core layers of identical thicknesses would be applied), which may lead to higher handling costs, and higher material costs.

Preferably, the composite of the core layer comprises at least one filler of the core layer is selected from the group consisting of: a salt, a stearate salt, calcium stearate, and zinc stearate. Stearates have the function of a stabilizer, and lead to a more beneficial processing temperature, and counteract decomposition of components of the composite during processing and after processing, which therefore provide long-term stability. Instead of or in addition to a stearate, for example calcium zinc may also be used as stabilizer. The weight content of the stabilizer(s) in the composite will preferably be between 1 and 5%, and more preferably between 1.5 and 4%.

The composite of the core layer preferably comprises at least one impact modifier comprising at least one alkyl methacrylates, wherein said alkyl methacrylate is preferably chosen from the group consisting of: methyl methacrylate, ethyl methacrylate, propyl methacrylate, isopropyl methacrylate, t-butyl methacrylate and isobutyl methacrylate. The impact modifier typically improves the product performance, in particular the impact resistance. Moreover, the impact modifier typically toughens the core layer and can therefore also be seen as toughening agent, which further reduces the risk of breakage. Often, the modifier also facilitates the production process, for example, as already addressed above, in order to control the formation of the foam with a relatively consistent (constant) foam structure. The weight content of the impact modifier in the composite will preferably be between 1 and 9%, and more preferably between 3 and 6%. Preferably, the substantially complete core layer is formed by either a foamed composite or a non-foamed (solid) composite. At least one plastic material used in the core layer is preferably free of any plasticizer in order to increase the desired rigidity of the core layer, which is, moreover, also favourable from an environmental point of view.

The core layer and/or another layer of the panel may comprise wood-based material, for example, MDF, HDF, wood dust, prefabricated wood, more particularly so-called engineered wood. This wood-based material may be part of a composite material of the core layer.

The density of the core layer typically varies from about 0.1 to 1.5 grams/cm3, preferably from about 0.2 to 1.4 grams/cm3, more preferably from about 0.3 to 1.3 grams/cm3, even more preferably from about 0.4 to 1.2 grams/cm3, even more preferably from about 0.5 to 1.2 grams/cm3, and most preferably from about 0.6 to 1.2 grams/cm3.

The polymer used in the core layer and/or the core layer as such preferably has an elastic modulus of more than 700 MPa (at a temperature of 23 degrees Celsius and a relative humidity of 50%). This will commonly sufficiently rigidity to the core layer, and hence to the parallelogrammatic/rhombic panel as such.

Preferably, the base layer comprises at least one foaming agent. The at least one foaming agent takes care of foaming of the base layer, which will reduce the density of the base layer. This will lead to light weight panels, which are lighter weight in comparison with panel which are dimensionally similar and which have a non-foamed base layer. The preferred foaming agent depends on the (thermo)plastic material used in the base layer, as well as on the desired foam ratio, foam structure, and preferably also the desired (or required) foam temperature to realise the desired foam ratio and/or foam structure. To this end, it may be advantageous to apply a plurality of foaming agents configured to foam the base layer at different temperatures, respectively. This will allow the foamed base layer to be realized in a more gradual, and more controller manner. Examples of two different foaming agents which may be present (simultaneously) in the base layer are azidicarbonamide and sodium bicarbonate. In this respect, it is often also advantageous to apply at least one modifying agent, such as methyl methacrylate (MMA), in order to keep the foam structure relatively consistent throughout the base layer.

The core preferably has a thickness of at least 3 mm, preferably at least 4 mm, and still more preferably at least 5 mm. The panel thickness is typically situated in between 3 and 10 mm, preferably in between 4 and 8 mm.

The density of the core preferably varies along the height of the core. This may positively influence the acoustic (sound-dampening) properties of the panels as such. Preferably, at a top section and/or a bottom section of at least one foamed core layer a crust layer may be formed. This at least one crust layer may form integral part of the core layer. More preferably, both the top section and the bottom section of the core layer form a crust layer enclosing the foam structure. The crust layer is a relatively closed (reduced porosity, preferably free of bubbles (cells)), and hence forms a relatively rigid (sub)layer, compared to the more porous foam structure. Commonly, though not necessary, the crust layer is formed by sealing (searing) the bottom and top surface of the core layer. Preferably the thickness of each crust layer is between 0.01 and 1 mm, preferably between 0.1 and 0.8 mm. A too thick crust will lead to a higher average density of the core layer which increases both the costs and the rigidity of the core layer. The thickness of the core layer (core layer) as such is preferably between 2 and 10 mm, more preferably between 3 and 8 mm, and is typically approximately 4 or 5 mm. Preferably, a top section and/or a bottom section of the (composite) core layer forms a crust layer having a porosity which is less than the porosity of the closed cell foam plastic material of the core layer, wherein the thickness of each crust layer is preferably between 0.01 and 1 mm, preferably between 0.1 and 0.8 mm.

Preferably, each panel comprises at least one backing layer affixed to a bottom side of the core layer, wherein said at least one backing layer at least partially made of a flexible material, preferably an elastomer. The thickness of the backing layer typically varies from about 0.1 to 2.5 mm. Non-limiting examples of materials whereof the backing layer can be made of are polyethylene, cork, polyurethane and ethylene-vinyl acetate. The thickness of a polyethylene backing layer is for example typically 2 mm or smaller. The backing layer commonly provides additional robustness and impact resistances to each panel as such, which increases the durability of the panels. Moreover, the (flexible) backing layer may increase the acoustic (sound-dampening) properties of the panels. In a particular embodiment, the core layer is composed of a plurality of separate core layer segments affixed to said at least one backing layer, preferably such that said core layer segments are mutually hingeable. The lightweight features of the panels are advantageous for obtaining a secure bond when installing the panel on vertical wall surfaces. It is also especially easy to install the panel at vertical corners, such as at inside corners of intersecting walls, pieces of furniture, and at outside corners, such as at entry ways. An inside or outside corner installation is accomplished by forming a groove in the core layer of the panel to facilitate bending or folding of the panel.

Each panel may comprises at least one reinforcing layer. At least one reinforcing layer may be situated in between the core and an upper substrate affixed to the core. At least one reinforcing layer may be situated in between two core layers. The application of a reinforcing layer may lead to further improvement of the rigidity of the panel as such. This may also lead to improvement of the acoustic (sound-dampening) properties of the panels. The reinforcement layer may comprise a woven or non-woven fibre material, for example a glass fibre material. They may have a thickness of 0.2-0.4 mm. It is also conceivable that each panel comprises a plurality of the (commonly thinner) core layer stacked on top of each other, wherein at least one reinforcing layer is situated in between two adjacent core layers. Preferably, the density of the reinforcing layer is preferably situated between 1.000 and 2.000 kg/m3, preferably between 1.400- and 1.900 kg/m3, and more preferably between 1.400-1.700 kg/m3.

Each panel preferably comprises an upper substrate affixed—directly or indirectly—to an upper side the core, wherein said upper substrate preferably comprises a decorative layer. The upper substrate is preferably at least partially made of at least one material selected from the group consisting of: metals, alloys, macromolecular materials such as vinyl monomer copolymers and/or homopolymers; condensation polymers such as polyesters, polyamides, polyimides, epoxy resins, phenol-formaldehyde resins, urea formaldehyde resins; natural macromolecular materials or modified derivatives thereof such as plant fibres, animal fibres, mineral fibres, ceramic fibres and carbon fibres. Here, the vinyl monomer copolymers and/or homo-polymers are preferably selected from the group consisting of polyethylene, polyvinyl chloride (PVC), polystyrene, polymethacrylates, polyacrylates, polyacrylamides, ABS, (acrylonitrile-butadiene-styrene) copolymers, polypropylene, ethylene-propylene copolymers, polyvinylidene chloride, polytetrafluoroethylene, polyvinylidene fluoride, hexafluoropropene, and styrene-maleic anhydride copolymers, and derivates thereof. The upper substrate most preferably comprises polyethylene or polyvinyl chloride (PVC). The polyethylene can be low density polyethylene, medium density polyethylene, high density polyethylene or ultra-high density polyethylene. The upper substrate layer can also include filler materials and other additives that improve the physical properties and/or chemical properties and/or the processability of the product. These additives include known toughening agents, plasticizing agents, reinforcing agents, anti-mildew (antiseptic) agents, flame-retardant agents, and the like. The upper substrate typically comprises a decorative layer and an abrasion resistant wear layer covering said decorative layer, wherein a top surface of said wear layer is the top surface of said panel, and wherein the wear layer is a transparent material, such that decorative layer is visible through the transparent wear layer.

Preferably, each panel comprises an upper substrate affixed—either directly or indirectly—to an upper side of the core, wherein said upper substrate preferably comprises a veneer layer. Said veneer layer preferably has a Mohs hardness of greater than 3. Said veneer layer preferably has a thickness of between 2 and 8 mm. Said veneer layer being dimensioned so as not to overlie the supporting core and/or the coupling parts. The veneer layer is preferably composed of a material selected from the group consisting of natural stone, marble, granite, slate, glass, and ceramics. More preferably, the veneer layer is a ceramic of a type selected from the group consisting of Monocuttura ceramic, Monoporosa ceramic, porcelain ceramic, or multi-casted ceramic. Preferably, the veneer layer has a breaking modulus greater than 10 N/mm2, more preferably greater than 30 N/mm2.

The thickness of the upper substrate typically varies from about 0.1 to 3.5 mm, preferably from about 0.5 to 3.2 mm, more preferably from about 1 to 3 mm, and most preferably from about 2 to 2.5 mm. The thickness ratio of the base layer to the upper substrate commonly varies from about 1 to 15:0.1 to 3.5, preferably from about 1.5 to 10:0.5 to 3.2, more preferably from about 1.5 to 8:1 to 3, and most preferably from about 2 to 8:2 to 2.5, respectively.

Each panel may comprise an adhesive layer to affix the upper substrate, directly or indirectly, onto the base layer. The adhesive layer can be any well-known bonding agent or binder capable of bonding together the upper substrate and the base layer, for example polyurethanes, epoxy resins, polyacrylates, ethylene-vinyl acetate copolymers, ethylene-acrylic acid copolymers, and the like. Preferably, the adhesive layer is a hot-melt bonding agent.

The decorative layer or design layer, which may be part of the upper substrate as mentioned above, can comprise any suitable known plastic material such as a known formulation of PVC resin, stabilizer, plasticizer and other additives that are well known in the art. The design layer can be formed with or printed with printed patterns, such as wood grains, metal or stone design and fibrous patterns or three-dimensional figures. Thus the design layer can provide the panel with a three dimensional appearance that resembles heavier products such as granite, stone or metal. The thickness of the design layer typically varies from about 0.01 to 0.1 mm, preferably from about 0.015 to 0.08 mm, more preferably from about 0.2 to 0.7 mm, and most preferably from about 0.02 to 0.5 mm. The wear layer that typically forms the upper surface of the panel can comprise any suitable known abrasion-resistant material, such as an abrasion-resistant macromolecular material coated onto the layer beneath it, or a known ceramic bead coating. If the wear layer is furnished in layer form, it can be bonded to the layer beneath it. The wear layer can also comprise an organic polymer layer and/or inorganic material layer, such as an ultraviolet coating or a combination of another organic polymer layer and an ultraviolet coating. For example, an ultraviolet paint capable of improving the surface scratch resistance, glossiness, antimicrobial resistance and other properties of the product. Other organic polymers including polyvinyl chloride resins or other polymers such as vinyl resins, and a suitable amount of plasticizing agent and other processing additives can be included, as needed.

In a preferred embodiment, at least one panel comprises a plurality of strip shaped upper substrates directly or indirectly affixed to an upper side the base layer, wherein said upper substrate are arranged side by side in the same plane, preferably in a parallel configuration. Here, the plurality of upper substrates preferably substantially completely cover the upper surface of the base layer, and more preferably extend from the first edge to the second edge of the panel. Each of the plurality of upper substrates comprises a decorative layer, wherein the decorative layers of at least two adjacently arranged upper substrates preferably have different appearances. The application of a plurality of strip shaped upper substrates, are arranged side by side in the same plane and directly or indirectly affixed to the base layer will create the attractive aesthetical effect that the chevron panels is defined by the strip shaped upper substrates as such, while having the advantages that during installation merely the panels as such will have to be coupled rather than the strip shaped upper substrate, which would be time-consuming and expensive.

The panel may comprise a plurality of first coupling parts and a plurality of second coupling parts. More in particular, each panel edge may be provided with either a first coupling or a second coupling part. Preferably, the first coupling part and/or the second coupling part are made of a flexible material, a semi-rigid material, and/or a rather rigid material which stills exhibits sufficient deformation to allow smooth coupling and the creation of pretension between the coupling parts in coupled state.

The panel according to the invention typically has a square, rectangular, triangular, hexagon, octagon, or other polygonal shape. However, other shapes, like a parallelogramical shape, are also imaginable. Preferably, in case of a panel with an even number of edges, the number of first coupling parts equals the number of second coupling parts. In case the panel has a parallelogramical shape, two pairs of adjacent edges enclose an acute angle, and wherein two pairs of other adjacent edges enclose a obtuse angle. These panels allow the creation of a so-called chevron pattern. The acute angle is typically situated between 30 and 60 degrees, and is preferably substantially 45 degrees. The obtuse angle is typically situated between 120 and 150 degrees, and is preferably substantially 135 degrees.

Preferably, for creating a chevron pattern, two different types of panels (A and B respectively), both according to the invention, are used, wherein the coupling parts of one panel type (A) are arranged in a mirror-inverted manner relative to the corresponding coupling parts of the other panel type (B). Distinctive visual markings, for example coloured labels, symbolic labels, (pre-attached) differently coloured backing layers, and/or text labels, may be applied to different panel types to allow a user to easily recognize the different panels types during installation. Preferably the visual markings are not visible in a coupled condition of the panels (from a top view). A visual marking may, for example, be applied onto the upper side of the upward tongue and/or inside the upward groove and/or inside the downward groove. It is imaginable that a covering, consisting of panels according to the invention, comprises more than two different types of panels.

In a preferred embodiment of the panel according to the invention, the panel comprises at least one third coupling part and at least one fourth coupling part connected respectively to opposite edges of the core, wherein the third coupling part comprises: a sideward tongue extending in a direction substantially parallel to the upper side of the panel, at least one second downward flank lying at a distance from the sideward tongue, and a second downward groove formed between the sideward tongue and the second downward flank, wherein the fourth coupling part comprises: a second groove configured for accommodating at least a part of the sideward tongue of the third coupling part of an adjacent panel, said second groove being defined by an upper lip and a lower lip, wherein said lower lip is provided with an upward locking element, wherein the third coupling part and the fourth coupling part are configured such that two of such panels can be coupled to each other by means of a turning movement, also referred to as a rotation movement or angling down movement, wherein, in coupled condition: at least a part of the sideward tongue of a first panel is inserted into the second groove of an adjacent, second panel, and wherein at least a part of the upward locking element of said second panel is inserted into the second downward groove of said first panel. Since the third coupling part is configured to be coupled to the fourth coupling part by means of a turning movement, also referred to as a rotational movement or angling down movement, and since the first coupling part is configured to be coupled to the second coupling part by means of a fold-down movement and/or vertical movement, also referred to as a scissoring movement or zipping movement, the panels according to the invention can still be installed by using the user-friendly fold-down installation technology. The advantages achieved by the couplings thus in general lie in an improved panel with improved coupling parts, wherein the advantage of a simple manufacture, by making use of easy to manufacture coupling parts, namely, because they do not necessarily have to make use of separate connection pieces, the advantage that the panels preferably can be installed according to the user-friendly fold-down principle, and the advantage of offering a relatively reliable and durable coupling, are combined. Preferably, the third coupling part and the fourth coupling part are configured such that a coupled condition is substantially free of pretension between the third coupling part and the fourth coupling part. This may facilitate the coupling of the panels as such.

The contact surface between the third coupling part and the fourth coupling part, in coupled condition, is preferably larger than the contact surface between the first coupling part and the second coupling part, in coupled condition. Preferably, the connection (coupling) between the first coupling part and the second coupling part leads to a firmer engagement per unit edge length in the longitudinal direction of the seam between two panels and parallel to the plane of the panel(s) than the connection (coupling) between the third coupling part and the fourth coupling part, in particular due to the pretension between the first coupling part and the second coupling part.

At least a part of the proximal side of the upward tongue may be inclined upwardly towards the upward flank, wherein the angle enclosed between the plane of the panel and the inclined part of the side of the upward tongue facing the upward flank lies between 90 and 45 degrees, in particular between 90 and 60 degrees, more in particular between 90 and 80 degrees. This inward inclination of the proximal side of the upward tongue, facing the upward flank, results in a so-called "closed-groove" locking system. In this arrangement, the 90 degree value of the claim is not part of the range. The claimed ranges indicate that the angle between the inclined part and the vertical are between 0 and 45 degrees, in particular 0 and 30 degrees, and more in particular between 0 and 10 degrees. As an exemplary value, this angle is about 2.5 degrees, which is thus the amount or value to which extent the inclined part is inclined inwards, towards the core. Such closed groove system is relatively difficult to coupled, since the coupling parts will need to at least temporarily deform during coupling. The benefit of such system however is that the inclined parts do contribute to a vertical locking of panels in coupled condition.

At least a part of the proximal side of the upward tongue may be inclined upwardly away from the upward flank, wherein the angle enclosed between the plane of the panel and the inclined part of the side of the upward tongue facing the upward flank lies between 90 and 180 degrees, in particular between 90 and 120 degrees, more in particular between 90 and 100 degrees. This results in a so-called "open-groove" system. Compared to the closed groove system, such open groove systems are relatively easy to couple, though will typically have a decreased vertical locking effect.

The invention also relates to a covering, in particular a floor covering, ceiling covering, or wall covering, comprising a plurality of mutually coupled panels according to the invention. The lightweight features of the panels are advantageous for obtaining a secure bond when installing the panel on vertical wall surfaces. It is also especially easy to install the panel at vertical corners, such as at inside corners of intersecting walls, pieces of furniture, and at outside corners, such as at entry ways.

The ordinal numbers used in this document, like "first", "second", "third", and "fourth" are used only for identification purposes. Hence, for example, the use of the expressions "third locking element" and "fourth locking element" does therefore not necessarily require the co-presence of a "first locking element" and a "second locking element".

The panels according to the invention may also be referred to as tiles or boards. The core layer may also be referred to as core layer. The coupling parts may also be referred to as coupling profiles or as connecting profiles. By "complementary" coupling parts is meant that these coupling parts can cooperate with each other. However, to this end, the complementary coupling parts do not necessarily have to have complementary forms. By locking in "vertical direction" is meant locking in a direction perpendicular to the plane of the panel. By locking in "horizontal direction" is meant locking in a direction perpendicular to the respective coupled edges of two panels and parallel to or falling together with the plane defined by the panels. In case in this document reference is made to a "floor panel" or "floor panel", these expressions may be replaced by expressions like "panel", "wall panel", "ceiling panel", "covering panel". In the context of this document, the expressions "foamed composite" and "foamed plastic material" (or "foam plastic material") are interchangeable, wherein in fact the foamed composite comprises a foamed mixture comprising at least one (thermos)plastic material and at least one filler (non-polymeric material).

Embodiments of the invention are presented in the following non-limitative exemplary clauses.

1. Panel, in particular a floor panel, ceiling panel, or wall panel, comprising:

a centrally located core provided with an upper side and a lower side, which core defines a plane;

at least one first coupling part and at least one second coupling part connected respectively to opposite edges of the core, which first coupling part comprises:

an upward tongue, at least one upward flank lying at a distance from the upward tongue, and an upward groove formed in between the upward tongue and the upward flank wherein the upward groove is adapted to receive at least a part of a downward tongue of a second coupling part of an adjacent panel, wherein at least a part of a proximal side of the upward tongue, facing the upward flank, is upwardly inclined towards the upward flank, which second coupling part comprises:

a downward tongue, at least one downward flank lying at a distance from the downward tongue, and a downward groove formed in between the downward tongue and the downward flank, wherein the downward groove is adapted to receive at least a part of an upward tongue of a first coupling part of an adjacent panel;

wherein at least a part of a proximal side of the downward tongue, facing the upward flank, is downwardly inclined towards the downward flank, wherein the first coupling part and the second coupling part are configured such that in coupled condition a pretension is existing, which forces the respective panels at the respective edges towards each other, wherein this is performed by applying overlapping contours of the first coupling part and the second coupling part, in particular overlapping contours of the downward tongue and the upward groove and/or overlapping contours of the upward tongue and the downward groove, and wherein the first coupling part and the second coupling part are configured such that the two of such panels can be coupled to each other by means of a fold-down movement and/or a vertical movement, such that, in coupled condition, wherein, in coupled condition, at least a part of the downward tongue of the second coupling part is inserted in the upward groove of the first coupling part, such that the downward tongue is clamped by the first coupling part and/or the upward tongue is clamped by the second coupling part.

2. Panel, in particular a floor panel, ceiling panel, or wall panel, preferably a panel according to clause 1, comprising:

a centrally located core provided with an upper side and a lower side, which core defines a plane;

at least one first coupling part and at least one second coupling part connected respectively to opposite edges of the core, which first coupling part comprises:

an upward tongue, at least one upward flank lying at a distance from the upward tongue, an upward groove formed in between the upward tongue and the upward flank wherein the upward groove is adapted to receive at least a part of a downward tongue of a second coupling part of an adjacent panel, and at least one first locking element, preferably provided at a distant side of the upward tongue facing away from the upward flank, which second coupling part comprises:

a downward tongue, at least one downward flank lying at a distance from the downward tongue, a downward groove formed in between the downward tongue and the downward flank, wherein the downward groove is adapted to receive at least a part of an upward tongue of a first coupling part of an adjacent panel, and at least one second locking element adapted for co-action with a first locking element of an adjacent panel, said second locking element preferably being provided at the downward flank, wherein the first coupling part and the second coupling part are configured such that in coupled condition a pretension is existing, which forces the respective panels at the respective edges towards each other, wherein this preferably is performed by applying overlapping contours of the first coupling part and the second coupling part, in particular overlapping contours of the downward tongue and the upward groove and/or overlapping contours of the upward tongue and the downward groove, and wherein the first coupling part and the second coupling part are configured such that the two of such panels can be coupled to each other by means of a fold-down movement and/or a vertical movement, such that, in coupled condition, wherein, in coupled condition, at least a part of the downward tongue of the second coupling part is inserted in the upward groove of the first coupling part, such that the downward tongue is clamped by first coupling part, such that at least a part of the second coupling part is clamped by the first coupling part and/or at least a part of the first coupling part is clamped by the second coupling part.

3. Panel according to any of the preceding clauses, wherein the downward tongue is oversized with respect to the upward groove.

4. Panel according to clause 3, wherein the width of the downward tongue is oversized with respect to the width of the upward groove.

5. Panel according to clause 4, wherein the maximum width of the downward tongue exceeds the maximum width of the upward groove.

6. Panel according to any of the preceding clauses, wherein the height of the downward tongue is equal to or smaller than the height of the upward groove.

7. Panel according to any of the preceding clauses, wherein the upward tongue is oversized with respect to the downward groove.

8. Panel according to clause 7, wherein the width of the upward tongue is oversized with respect to the width of the downward groove.

9. Panel according to clause 8, wherein the maximum width of the upward tongue exceeds the maximum width of the downward groove.

10. Panel according to any of the preceding clauses, wherein the height of the upward tongue is equal to or smaller than the height of the downward groove.

11. Panel according to any of the preceding clauses, wherein a lower side of the first coupling part is provided with a recessed portion configured to allow downward bending of the upward tongue, preferably such that the upward groove is widened to facilitate coupling of two panels.

12. Panel according to any of clause 11, wherein, in a coupled state of adjacent panels, the upward tongue of the coupled first coupling part is bent outwardly and the upward groove of said first coupling part is widened compared to the uncoupled state of said first coupling part.

13. Panel according to any of clauses 11-12, wherein, in cross-sectional view of the panel, the recessed portion has a substantially rectangular shape or inclined shape.

14. Panel according to any of the preceding clauses, wherein the first coupling part comprises a lower bridge connected to the core of the panel, wherein the upward tongue is connected to said lower bridge and extends in upward direction with respect to said lower bridge.

15. Panel according to one of clauses 12-13 and clause 14, wherein the recessed portion is provided underneath both at least a part of the upward tongue and at least a part of the lower bridge.

16. Panel according to any of the preceding clauses, wherein during coupling the upward tongue bends downwardly, and then returns in the direction of its initial position.

17. Panel according to any of the preceding clauses, wherein the upper side of the upward tongue is inclined, and runs downward from the proximal side of the upward tongue, facing toward the upward flank, towards the distant side of the upward tongue, facing away from the upward flank.

18. Panel according to the any of the preceding clauses, wherein the first locking element comprises a bulge and/or a recess, and wherein the second locking element comprises a bulge and/or a recess.

19. Panel according to any of the preceding clauses, wherein a part of a side of the downward tongue facing away from the downward flank is provided with a third locking element, for instance in the form of an outward bulge or a recess, adapted for co-action with a fourth locking element, for instance in the form of a recess or an outward bulge, of an adjacent panel; and wherein at least a part of the upward flank is provided with a fourth locking element, for instance in the form of a recess or an outward bulge, adapted for co-action with the third locking element, for instance in the form of an outward bulge or a recess, of an adjacent panel.

20. Panel according to clause 19, wherein instead of the first and second locking elements, the panel comprises the third and fourth locking elements.

21. Panel according to any of the preceding clauses, wherein the first coupling part and the second coupling part are integrally formed with the core.

22. Panel according to any of the preceding clauses, wherein the first coupling part and the second coupling part are made of a flexible material or of a semi-rigid material.

23. Panel according to any of the preceding clauses, wherein the core comprises a plurality of layers.

24. Panel according to any of the preceding clauses, wherein the panel comprises a plurality of first coupling parts and a plurality of second coupling parts.

25. Panel according to any of the preceding clauses, wherein the first coupling part and the second coupling part are made of a flexible material or of a semi-rigid material.

26. Panel according to one of the foregoing clauses, wherein the panel has a polygonal shape, in particular a square shape and/or rectangular shape.

27. Panel according to one of the foregoing clauses, wherein the panel has a parallelogramical shape, wherein two pairs of adjacent edges enclose an acute angle, and wherein two pairs of other adjacent edges enclose a obtuse angle.

28. Panel according to any of the preceding clauses, wherein the panel comprises at least one third coupling part and at least one fourth coupling part connected respectively to opposite edges of the core, wherein the third coupling part comprises:

- a sideward tongue extending in a direction substantially parallel to the upper side of the core,
- at least one second downward flank lying at a distance from the sideward tongue, and
- a second downward groove formed between the sideward tongue and the second downward flank, wherein the fourth coupling part comprises:

- a second groove configured for accommodating at least a part of the sideward tongue of the third coupling part of an adjacent panel, said second groove being defined by an upper lip and a lower lip, wherein said lower lip is provided with an upward locking element, wherein the third coupling part and the fourth coupling part are configured such that two of such panels can be coupled to each other by means of a turning movement, wherein, in coupled condition: at least a part of the sideward tongue of a first panel is inserted into the second groove of an adjacent, second panel, and wherein at least a part of the upward locking element of said second panel is inserted into the second downward groove of said first panel.

29. Panel according to clause 28, wherein the third coupling part and the fourth coupling part are configured such that a coupled condition is substantially free of pre-tension between the third coupling part and the fourth coupling part.

30. Covering, in particular a floor covering, ceiling covering, or wall covering, comprising a plurality of mutually coupled panels according to any of clauses 1-29.

BRIEF DESCRIPTION OF THE DRAWINGS

The invention will now be elucidated on the basis of non-limitative exemplary embodiments which are illustrated in the following figures. Corresponding elements are denoted in the figures by corresponding reference numbers. In the figures.

DESCRIPTION OF THE INVENTION

Figure 1A:
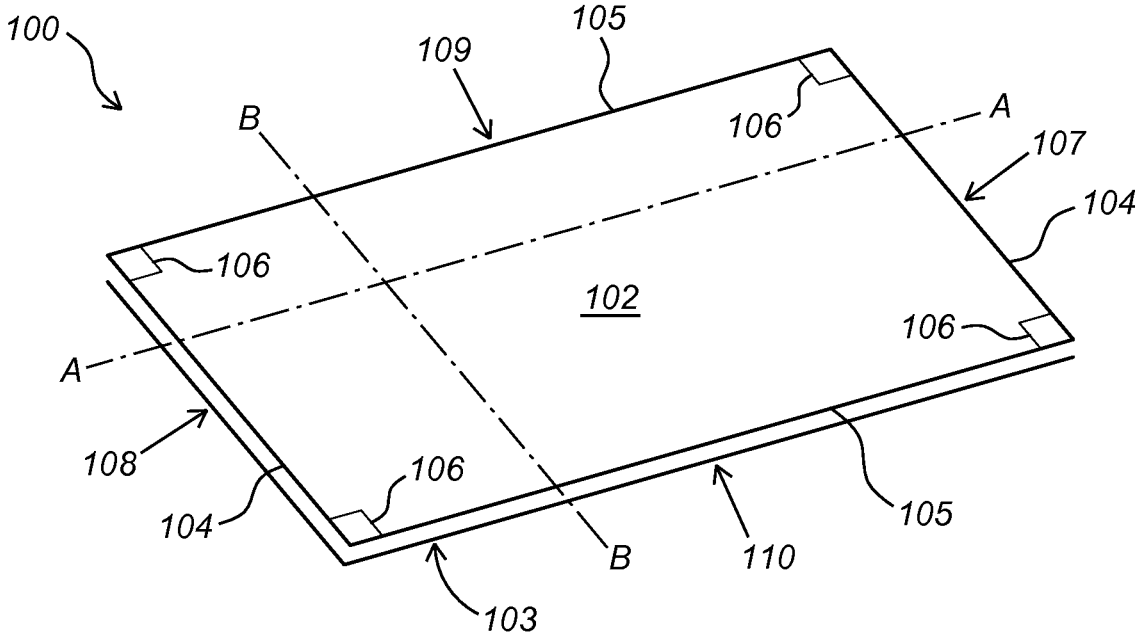
FIG. 1*a* shows a schematic representation of a panel according to the invention.

FIG. 1*a* shows a schematic representation of a panel (100) according to the invention, having a polygonal shape. In this specific embodiment, the panel (100) has a rectangular upper side (102) and lower side (103) and comprises two pairs of opposite edges (104, 105). Each two adjacent edges hereby enclose a right angle (106). A first coupling part (107) and a second coupling part (108) are respectively connected to a different edge of one pair of opposite edges (104). The panel (100) is further provided with a third coupling part (109) and a fourth coupling part (110), respectively connected to a different edge of the other pair of opposite edges (105).

Figure 1B:
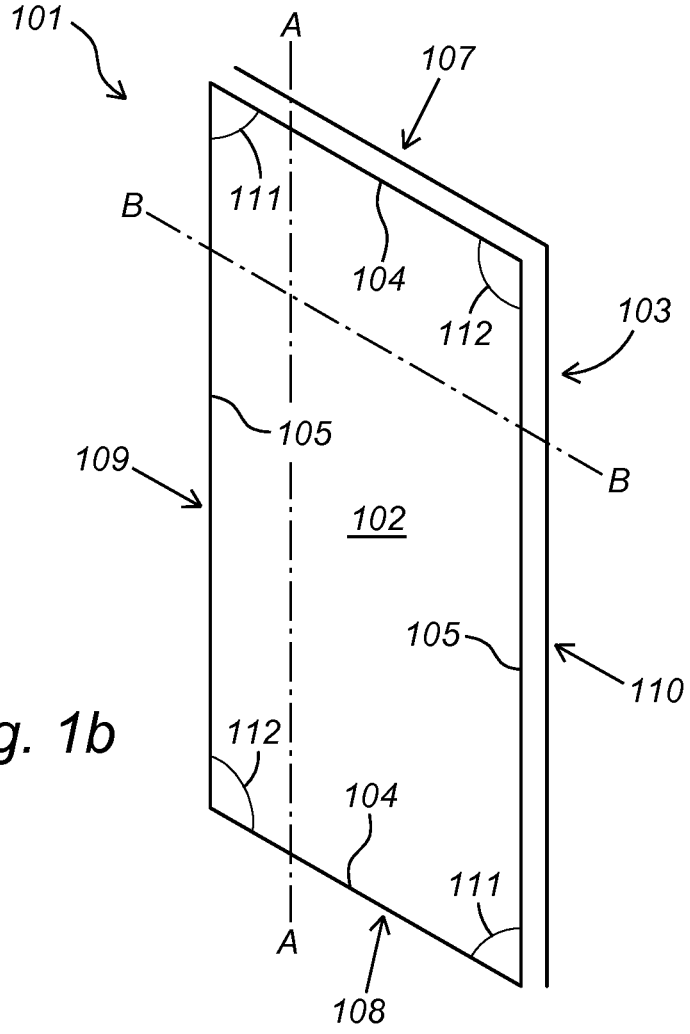
FIG. 1*b* shows a schematic representation of another panel according to the invention.

FIG. 1*b* shows a schematic representation of another panel (101) according to the invention, being parallelogram-shaped. The panel (101) has a parallelogram-shaped upper side (102) and lower side (103) and comprises two pairs of opposite edges (104, 105). Two pairs of adjacent edges hereby enclose an acute angle (111), wherein the other two pairs of adjacent edges enclose an obtuse angle (112).

Figure 2A:
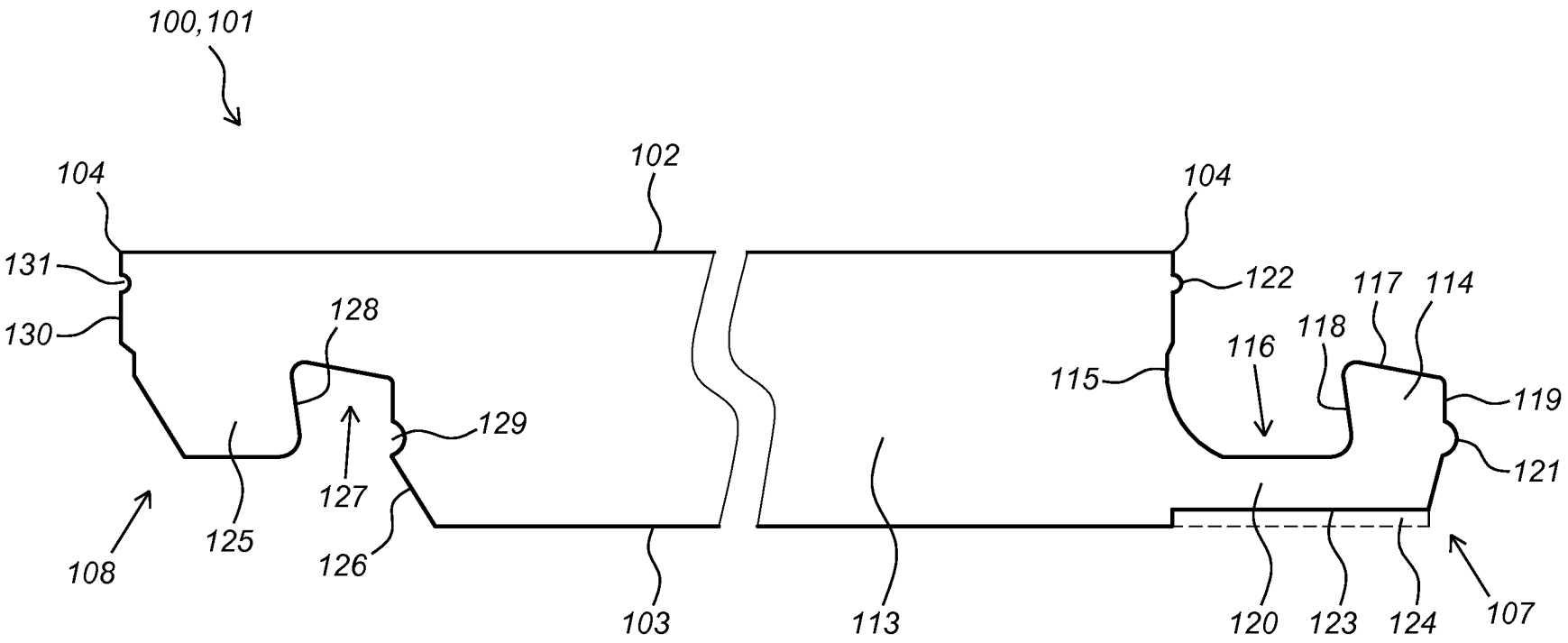
FIG. 2*a* shows a cross-section of a panel as shown in FIGS. 1*a* and 1*b* taken along line A-A.

FIG. 2*a* shows a cross-section of a panel (100, 101) as shown in FIGS. 1*a* and 1*b* taken along line A-A. The panel (100, 101) comprises a centrally located core (113), defining the upper side (102) and the lower side (103) of the panel (100, 102). Connected to the core (113) at opposite edges (104) of the panel (100, 101) are the first coupling part (107) and the second coupling part (108).

The first coupling part (107) comprises an upward tongue (114), an upward flank (115) lying at a distance from the upward tongue (114), an upward groove (116) formed in between the upward tongue (114) and the upward flank (115). The upper side (117) of the upward tongue (114) is inclined such that it runs downward from a proximal side (118) of the upward tongue (114), facing the upward flank (115) towards a distant side (119) of the upward tongue (114) facing away from the upward flank (115). The upward tongue (114) is connected to a lower bridge (120) that is connected to the core (113) of the panel (100, 101). The upward tongue (114) hereby extends in an upward direction with respect to the lower bridge (120). A part of the proximal side (118) of the upward tongue (114) is upwardly inclined towards the upward flank (115). At the distant side (119) of the upward tongue (114) the upward tongue (114) is further provided with a first locking element (121), which takes the form of an outward bulge. Additionally, a fourth locking element (122), also in the form of an outward bulge, is provided on the upward flank (115). A lower side (123) of the first coupling part (107) is provided with a recessed portion (124) which provides room for the upward tongue (114) to bend downwards. In the depicted panel (100, 101), the recessed portion (124) is provided underneath both the upward tongue (114) and the lower bridge (120).

The second coupling part (108) comprises a downward tongue (125), at least one downward flank (126) lying at a distance from the downward tongue (125) and a downward groove (127) formed in between the downward tongue (125) and the downward flank (126). A part of a proximal side (128) of the downward tongue (125), facing the downward flank (126), is downwardly inclined towards the downward flank (126). The downward flank (126) is further provided with a second locking element (129) adapted for co-action with a first locking element (121) of an adjacent panel (100, 101). A distal side (130) of the downward tongue (125), facing away from the downward flank (126), is additionally provided with a third locking element (131), taking the form of a recess. The third locking element (131) is adapted for co-action with a fourth locking element (122) of an adjacent panel (100, 101).

Figure 2B:
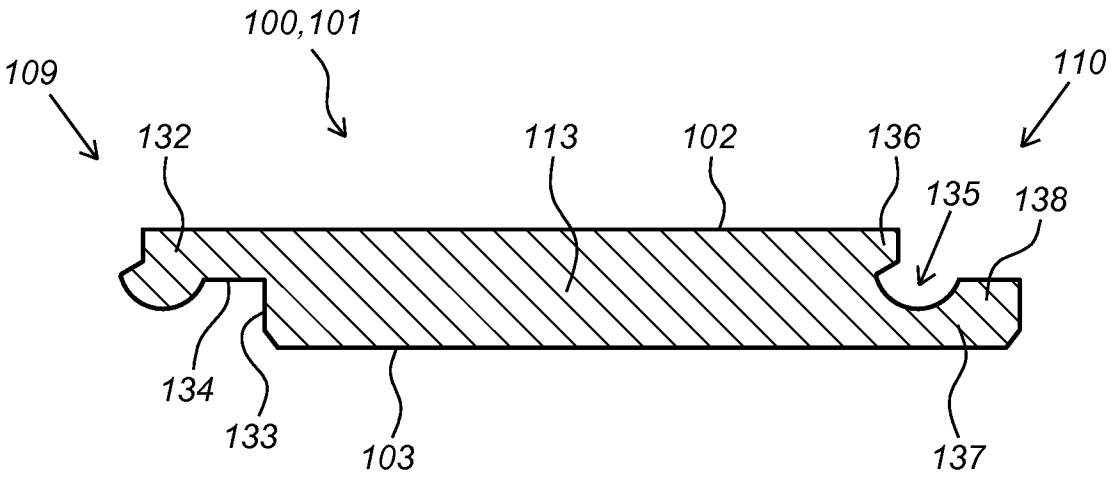
FIG. 2*b* shows a cross-section of a panel as shown in FIGS. 1*a* and 1*b* taken along line B-B.

FIG. 2*b* shows a cross-section of a panel (100, 101) as shown in FIGS. 1*a* and 1*b* taken along line B-B. The centrally located core (113) of the panel (100, 101) is again visible, defining the upper side (102) and the lower side (103) of the panel (100, 101). Connected to the core (113) at opposite edges (105) of the panel (100, 101) are the third coupling part (109) and the fourth coupling part (110).

The third coupling part (109) comprises a sideward tongue (132) extending in a direction substantially parallel to the upper side (102) of the panel (100, 101), at least one second downward flank (133) lying at a distance from the sideward tongue (132), and a second downward groove (134) formed between the sideward tongue (132) and the second downward flank (133). The fourth coupling part (110) comprises a second groove (135) configured for accommodating at least a part of the sideward tongue (132) of the third coupling part (109) of an adjacent panel (100, 101), said second groove (135) being defined by an upper lip (136) and a lower lip (137), wherein said lower lip (137) is provided with an upward locking element (138).

Figure 3A:
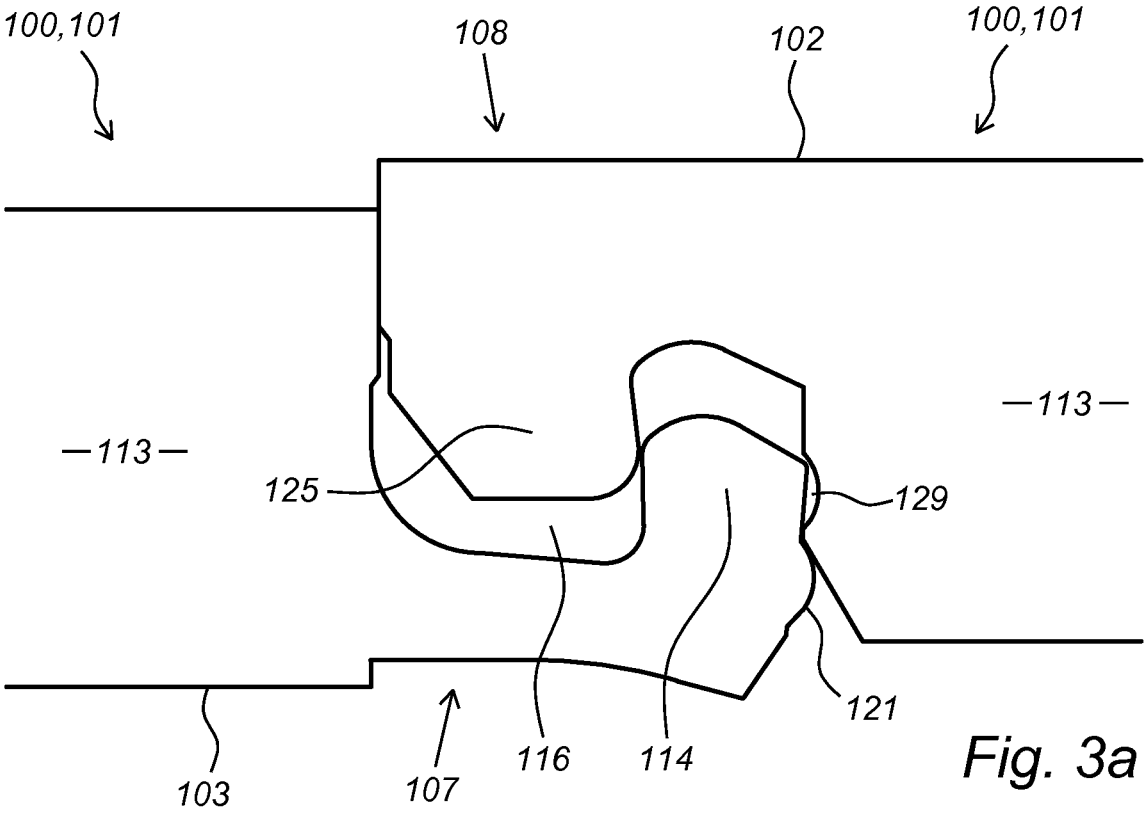
FIG. 3*a* shows a cross-section of two panels as shown in FIGS. 1*a* and 1*b*, being coupled together at a first and a second coupling part respectively.
Figure 3B:
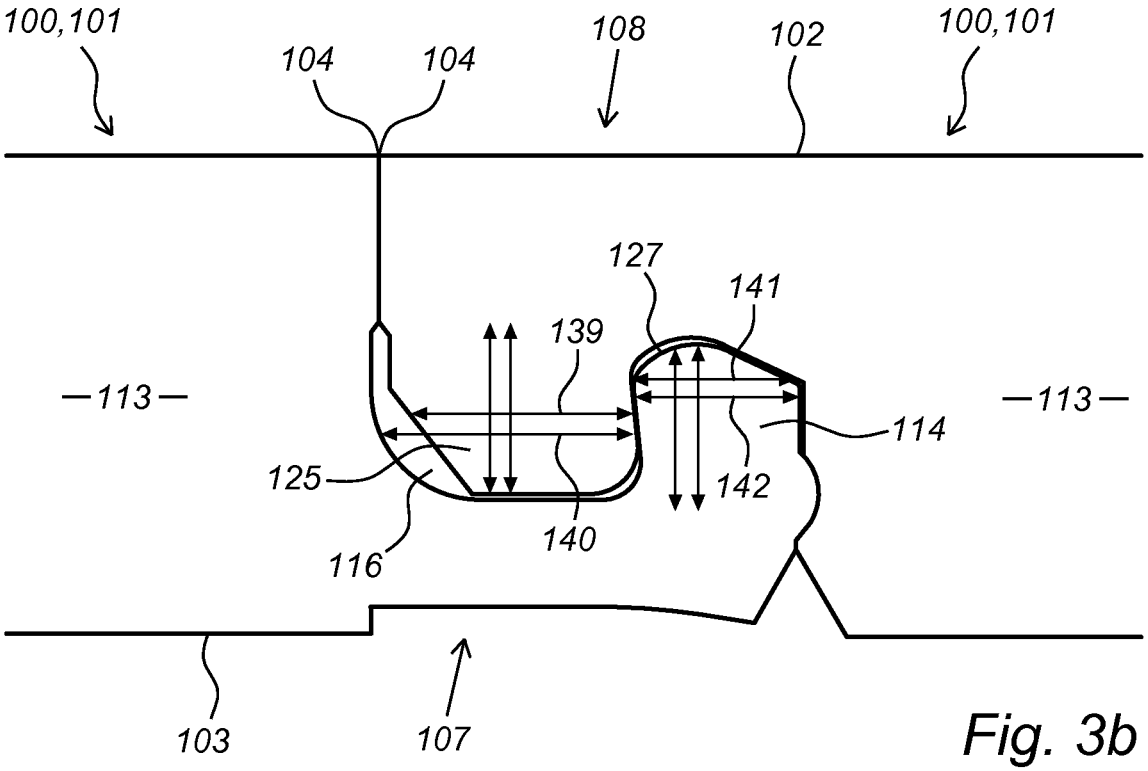
FIG. 3*b* shows a cross-section of the two panels as shown in FIG. 3*a* in a coupled position.

FIG. 3*a* shows a cross-section of two panels (100, 101) as shown in FIGS. 1*a* and 1*b*, being coupled together at a first coupling part (107) and a second coupling part (108) respectively. Due to the shown configuration of the first coupling part (107) and the second coupling part (108), the two panels (100, 101) are coupled to each other by means of a fold-down movement and/or a vertical movement. This movement allows the downward tongue (125) of the second coupling part (108) to be inserted in the upward groove (116) of the first coupling part (107), which goes along with a downward bending of the upward tongue (114), as a result of which the upward groove (116) is widened. As can be seen in FIG. 3*b*, the upward tongue (114) will after that return in the direction of its initial position.

FIG. 3*b* shows a cross-section of the two panels (100, 101) as shown in FIG. 3*a* in a coupled position, wherein the downward tongue (125) is clamped by the first coupling part (107) and/or the upward tongue (114) is clamped by the second coupling part (108). As the first coupling part (107) and the second coupling part (108) have overlapping contours, a pretension exists within said coupling parts (107, 108) that forces the two panels (100, 101) and their edges (104) towards each other. Specifically, the downward tongue (125) is oversized with respect to the upward groove (116) wherein the maximum width (139) of the downward tongue (125) exceeds the maximum width (140) of the upward groove (116). Additionally, the upward tongue (114) is oversized with respect to the downward groove (127) wherein the maximum width (141) of the upward tongue (114) exceeds the maximum width (142) of the downward groove (127). To ensure a level connection of the upper sides (102) of the respective panels (100, 101), the height (143) of the downward tongue (125) is however equal to (or smaller than) the height (144) of the upward groove (116) and the height (145) of the upward tongue (114) is equal to (or smaller than) the height (146) of the downward groove (127).

The invention claimed is:

1. A panel, in particular a floor panel, ceiling panel, or wall panel, comprising:

a centrally located core provided with an upper side and a lower side, which core defines a plane;

at least one first coupling part and at least one second coupling part connected respectively to opposite edges of the core, which first coupling part comprises:

an upward tongue, at least one upward flank lying at a distance from the upward tongue, and an upward groove formed in between the upward tongue and the upward flank wherein the upward groove is adapted to receive at least a part of a downward tongue of a second coupling part of an adjacent panel, at least one first locking element, provided at a distant side of the upward tongue facing away from the upward flank;

wherein at least a part of a proximal side of the upward tongue, facing the upward flank, is upwardly inclined towards the upward flank, which second coupling part comprises:

a downward tongue, at least one downward flank lying at a distance from the downward tongue, and a downward groove formed in between the downward tongue and the downward flank, wherein the downward groove is adapted to receive at least a part of an upward tongue of a first coupling part of an adjacent panel;

at least one second locking element adapted for co-action with a first locking element of an adjacent panel, said second locking element being provided at the downward flank wherein at least a part of a proximal side of the downward tongue, facing the upward flank, is downwardly inclined towards the downward flank, wherein the first coupling part and the second coupling part are configured such that in coupled condition a pretension is existing, which forces the respective panels at the respective edges towards each other, wherein this is performed by applying overlapping contours of the downward tongue and the upward groove and overlapping contours of the upward tongue and the downward groove, and wherein the first coupling part and the second coupling part are configured such that the two of such panels can be coupled to each other by means of a fold-down movement and/or a vertical movement, such that, in coupled condition, wherein, in coupled condition, at least a part of the downward tongue of the second coupling part is inserted in the upward groove of the first coupling part, such that the downward tongue is clamped by the first coupling part and/or the upward tongue is clamped by the second coupling part, and wherein the upward tongue is oversized with respect to the downward groove; wherein the width of the upward tongue is oversized with respect to the width of the downward groove; wherein the maximum width of the upward tongue exceeds the maximum width of the downward groove; wherein the first locking element comprises a bulge, and wherein the second locking element comprises a recess, wherein a part of a side of the downward tongue facing away from the downward flank is provided with a third locking element, in the form of an outward bulge, adapted for co-action with a fourth locking element, in the form of a recess, of an adjacent panel; and wherein at least a part of the upward flank is provided with a fourth locking element, in the form of a recess, adapted for co-action with the third locking element, in the form of an outward bulge, of an adjacent panel, and wherein in a coupled state of adjacent panels, the upward tongue and the downward flank are in contact at mating surfaces immediately adjacent and below the coupled first locking element and the second locking element.

2. The panel according to claim 1, wherein the downward tongue is oversized with respect to the upward groove.

3. The panel according to claim 2, wherein the width of the downward tongue is oversized with respect to the width of the upward groove.

4. The panel according to claim 3, wherein the maximum width of the downward tongue exceeds the maximum width of the upward groove.

5. The panel according to claim 1, wherein the height of the downward tongue is equal to or smaller than the height of the upward groove.

6. The panel according to claim 1, wherein the upward tongue is at least 3%, or at least 5% oversized with respect to the downward groove.

7. The panel according to claim 1, wherein the height of the upward tongue is equal to or smaller than the height of the downward groove.

8. The panel according to claim 1, wherein a lower side of the first coupling part is provided with a recessed portion configured to allow downward bending of the upward tongue, such that the upward groove is widened to facilitate coupling of two panels.

9. The panel according to claim 8, wherein, in a coupled state of adjacent panels, the upward tongue of the coupled first coupling part is bent outwardly and the upward groove of said first coupling part is widened compared to the uncoupled state of said first coupling part.

10. The panel according to claim 8, wherein, in cross-sectional view of the panel, the recessed portion has a substantially rectangular shape or inclined shape.

11. The panel according to claim 1, wherein the first coupling part comprises a lower bridge connected to the core of the panel, wherein the upward tongue is connected to said lower bridge and extends in upward direction with respect to said lower bridge.

12. The panel according to claim 9, wherein the recessed portion is provided underneath both at least a part of the upward tongue and at least a part of the lower bridge.

13. The panel according to claim 1, wherein during coupling the upward tongue bends downwardly, and then returns in the direction of its initial position.

14. The panel according to claim 1, wherein the upper side of the upward tongue is inclined, and runs downward from the proximal side of the upward tongue, facing toward the upward flank, towards the distant side of the upward tongue, facing away from the upward flank.

15. The panel according to claim 1, wherein the first coupling part and the second coupling part are integrally formed with the core.

16. The panel according to claim 1, wherein the first coupling part and the second coupling part are made of a flexible material or of a semi-rigid material.

17. The panel according to claim 1, wherein the core comprises a plurality of layers.

18. The panel according to claim 1, wherein the panel comprises a plurality of first coupling parts and a plurality of second coupling parts.

19. The panel according to claim 1, wherein the panel has a polygonal shape, a square shape or rectangular shape.

20. The panel according to claim 1, wherein the panel has a parallelogramical shape, wherein two pairs of adjacent edges enclose an acute angle, and wherein two pairs of other adjacent edges enclose a obtuse angle.

21. The panel according to claim 1, wherein the panel comprises at least one third coupling part and at least one fourth coupling part connected respectively to opposite edges of the core, wherein the third coupling part comprises:

a sideward tongue extending in a direction substantially parallel to the upper side of the core, at least one second downward flank lying at a distance from the sideward tongue, and a second downward groove formed between the sideward tongue and the second downward flank, wherein the fourth coupling part comprises:

a second groove configured for accommodating at least a part of the sideward tongue of the third coupling part of an adjacent panel, said second groove being defined by an upper lip and a lower lip, wherein said lower lip is provided with an upward locking element, wherein the third coupling part and the fourth coupling part are configured such that two of such panels can be coupled to each other by means of a turning movement, wherein, in coupled condition: at least a part of the sideward tongue of a first panel is inserted into the second groove of an adjacent, second panel, and wherein at least a part of the upward locking element of said second panel is inserted into the second downward groove of said first panel.

22. The panel according to claim 21, wherein the third coupling part and the fourth coupling part are configured such that a coupled condition is substantially free of pre-tension between the third coupling part and the fourth coupling part.

23. A covering, a floor covering, ceiling covering, or wall covering, comprising a plurality of mutually coupled panels according to claim 1.

* * * * *